US006332255B1

(12) United States Patent
Buchsbaum et al.

(10) Patent No.: US 6,332,255 B1
(45) **Date of Patent: *Dec. 25, 2001**

(54) PROCESS FOR PRODUCING A HOT-ROLLED PRODUCT AND PLANT FOR CARRYING OUT THE PROCESS

(75) Inventors: Bernhard Buchsbaum, St. Georgen; Karl Christian Gruber, Pucking, both of (AT)

(73) Assignee: Voest-Alpine Industrieanlagenbau GmbH, Linz (AT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/166,964

(22) Filed: Oct. 6, 1998

(30) Foreign Application Priority Data

Oct. 10, 1997 (AT) ..... A 1721/97

(51) Int. Cl.[7] ..... B21B 15/00
(52) U.S. Cl. ..... 29/33 C; 29/527.7; 72/202
(58) Field of Search ..... 29/33 C, 527.7; 72/202

(56) References Cited

U.S. PATENT DOCUMENTS

| | | | | |
|---|---|---|---|---|
| 4,675,974 | * | 6/1987 | Connolly | 29/527.7 |
| 5,035,036 | * | 7/1991 | Bohnenkamp | 29/33 C |
| 5,075,953 | * | 12/1991 | Braud | 29/527.7 |

(List continued on next page.)

FOREIGN PATENT DOCUMENTS

| | | |
|---|---|---|
| 13901582 | 8/1990 | (DE) . |
| 14001288 | 7/1991 | (DE) . |
| 0319808A | 6/1989 | (EP) . |
| 0492226B | 3/1995 | (EP) . |
| 10492226 | 3/1995 | (EP) . |
| 10648552 | 4/1995 | (EP) . |
| 0674952A | 10/1995 | (EP) . |
| 0593002B | 9/1996 | (EP) . |
| 10593002 | 9/1996 | (EP) . |
| 0908244A | 4/1999 | (EP) . |
| 2656680 | 7/1991 | (FR) . |

OTHER PUBLICATIONS

"Coulee continue de brames minces et laminage combines: une technologie de VAI", A.Flick, A. Eberle, F. Hirschmanner, K.L. Schwaha, La Revue de Metallurgie—CIT, Jul.–Aug. 1991, pp. 765–779.

*Primary Examiner*—S. Thomas Hughes
*Assistant Examiner*—Essama Omgba
(74) *Attorney, Agent, or Firm*—Birch, Stewart, Kolasch & Birch, LLP

(57) ABSTRACT

In a process for producing a hot-rolled product by continuously casting a strand, separating a strand piece from the strand, thermally influencing the strand piece by temperature equalization and/or strand piece heating and hot-rolling the strand piece, continuous casting takes place at two or several continuous casters. The strand pieces are rolled in a rolling mill associated with these continuous casters, to which the strand pieces are conducted by diverting the strand pieces into the line of the rolling mill from at least one of the continuous casters whose line does not register with the line of the rolling mill. In order to reach a higher plant availability, thermal influence of the strand pieces to be diverted is effected during the diversion of the strand pieces after their emergence from the continuous caster line and prior to their introduction into the rolling mill line while completely clearing the continuous caster lines and the rolling mill line.

3 Claims, 3 Drawing Sheets

U.S. PATENT DOCUMENTS 5,115,547 * 5/1992 Rohde ..... 29/33 C
5,182,847 * 2/1993 Guse et al. ..... 29/527.7
5,305,515 * 4/1994 Fastert et al. ..... 29/527.7
5,461,770 * 10/1995 Kimura et al. ..... 29/527.7
5,467,518 * 11/1995 Mertens ..... 29/527.7
5,560,095 * 10/1996 Kruger ..... 29/527.7
5,769,149 * 6/1998 Mertens ..... 164/418
5,943,753 * 8/1999 Buchsbaum et al. ..... 29/33 C
5,946,783 * 9/1999 Plociennik et al. ..... 29/33 C
5,970,594 * 10/1999 Borsi et al. ..... 29/81.08
6,018,855 * 2/2000 Drigani et al. ..... 29/33 C
6,122,950 * 9/2000 Rosenthal et al. ..... 72/202
6,209,187 * 4/2001 Boeke ..... 29/527.7

* cited by examiner

PROCESS FOR PRODUCING A HOT-ROLLED PRODUCT AND PLANT FOR CARRYING OUT THE PROCESS

BACKGROUND OF THE INVENTION

1. Field of the Invention

The invention relates to a process for producing a hot-rolled product by continuously casting a strand, separating a strand piece from the strand, thermally influencing the strand piece by temperature equalization and/or strand piece heating, and hot-rolling the strand piece, wherein continuous casting takes place at two or several continuous casters and the strand pieces are rolled in a rolling mill associated with these continuous casters and to which the strand pieces are conducted by diverting the strand pieces into the line of the rolling mill from at least one of the continuous casters whose line does not register with the line of the rolling mill, as well as an arrangement for carrying out the process.

2. Prior Art

A process of this kind as well as an arrangement for carrying out the process are known from EP-B 0 492 226 and EP-B 0 593 002.

According to EP-B 0 492 226, the diversion of a strand piece from the line of one of the continuous casters into the line of the rolling mill is effected by means of two guide sections designed as swing furnaces, wherein one swing furnace is arranged in the line of the continuous caster and the second swing furnace is arranged in the line of the rolling mill and both of the swing furnaces in one pivoted position each are capable of being aligned so as to register with the line in which they are arranged and in a second pivoted position each are capable of being placed in a straight line connection with the free ends of the two swing furnaces joining each other.

It is thereby possible, after having introduced a strand piece into the swing furnace arranged in the line of the continuous caster, to pass over into the swing furnace provided in the line of the rolling mill by pivoting the swing furnaces into the connected position and to subsequently feed the thus diverted strand piece to the rolling mill by pivoting back the second swing furnace into the line of the rolling mill.

A very similar method and arrangement are known from EP-B 0 593 002, wherein also there two pivotable or laterally movable furnaces are provided, which serve to divert a strand part from a line of a continuous caster into the line of the rolling mill. Also there, the two movable furnaces join each other in an aligned manner, yet the conveying direction of the strand part is reversed two times, i.e., the strand piece when being conveyed from one line to the other moves in the opposite direction to the conveying direction of the continuous caster and the rolling mill.

Those known processes and plants involve the drawback of the imperative timed coupling of the two pivotable or movable furnaces, since they must be aligned to mutually register in order to divert a strand piece. Hence results the timed coupling of the lines of the continuous casters with the line of the rolling mill. During diversion it is, in fact, not feasible to continue to operate the line from which, or into which, the strand piece is to be conveyed, i.e., the interruption of operation is absolutely necessary until the strand piece to be diverted has moved totally out of one line and into that line into which it is to be brought, thus being conveyed further.

The invention aims at avoiding these drawbacks and difficulties and has as its object to provide a process of the initially defined kind and a plant for carrying out this process, which allow for the rolling of strand pieces from two or several casters by means of a single rolling mill, wherein, however, the casting and rolling operations may be organized in a largely flexible manner and, in particular, decoupling from a time-dependent diversion of a strand piece is to be ensured to the effect that not all of the lines involved in the diversion of a strand piece will be out of operation simultaneously for conveying further strand pieces; it rather is to be feasible, even after having started or terminated the diversion of a strand piece from one line into another line to keep the other line still going, nevertheless.

SUMMARY OF THE INVENTION

In accordance with the invention, this object is achieved in that a thermal influence of the strand pieces to be diverted is effected during the diversion of the strand pieces, i.e., after the extraction of the strand pieces from the line of the continuous caster and prior to their introduction into the line of the rolling mill while completely clearing the lines of the continuous casters and the line of the rolling mill.

Suitably, the diversion of the strand pieces is effected with a two-time inversion of the direction, wherein, after a first diversion of the direction, a storage furnace is passed in a direction opposite to the casting direction and rolling direction and, after this, a second inversion of the direction is effected.

A plant for carrying out the process, comprising two or several continuous casters and a rolling mill associated with the same, wherein a pivotable or laterally displaceable guide section for a strand piece separated from a strand is provided in each of the lines of the continuous casters and/or the rolling mill, is characterized in that a furnace receiving a strand piece is provided between the line of a continuous caster and the line of the rolling mill, to one end of which furnace a pivotable or laterally displaceable guide section of a line of a continuous caster and to the opposite end of which furnace a pivotable or laterally displaceable guide section provided in the line of the rolling mill are capable of being aligningly joined.

By arranging a furnace between the lines, an additional storage means is provided, into which a strand piece may be introduced while the line into which the strand piece is to be transferred afterwards is still continuously operating. With the operation of all lines being maintained, heat treatment of the strand piece may then be carried out in that furnace. This strand piece is transferred to the other line only after a free capacity has been logistically provided in this line. Thereby, the timing of the transfer is independent of a simultaneous interruption of the two lines involved.

Preferably, the furnace provided between the lines is stationarily arranged.

Suitably, the furnace is designed as a storage furnace.

A preferred embodiment is characterized in that at least one pivotable guide section comprising two or several guide parts, preferably mutually arranged in a V-shaped manner, for receiving strand pieces is provided, wherein, as a function of the pivoted position or displacement position of this guide section, once one of the guide parts and once another guide part is capable of being aligned with the line of a continuous caster and/or the line of the rolling mill. This offers an even higher plant availability, the more so as the material flow in the line of the rolling mill merely need be interrupted by an even shorter time interval when diverting a strand piece.

Preferably, the guide sections and optionally provided guide parts are designed as furnaces.

A space-saving embodiment is characterized in that the rolling mill with its line is arranged to register with the line of one of the continuous casters, with an arrangement of the rolling mill with its line between two neighboring lines of two continuous casters being feasible as well.

BRIEF DESCRIPTION OF THE DRAWINGS

In the following, the invention will be explained in more detail by way of three exemplary embodiments illustrated in the accompanying schematic drawing, wherein.

DETAILED DESCRIPTION OF PREFERRED EMBODIMENTS OF THE INVENTION

Figure 1:
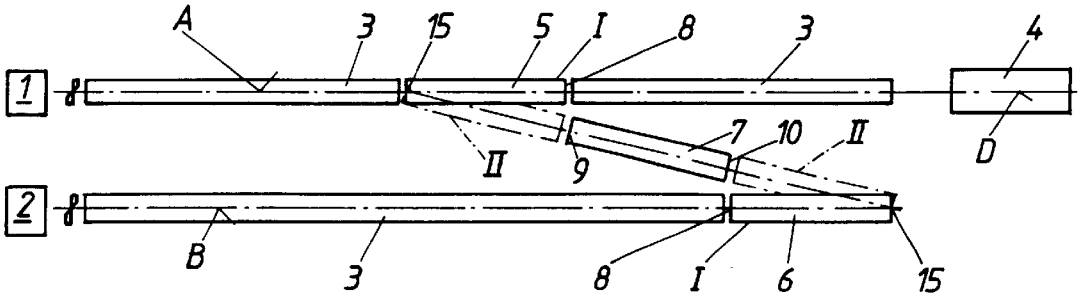
FIGS. 1 to 3 are top views on a first embodiment in different operating states.

Two continuous casters—for instance, for casting thin slabs, billets or blooms, etc.—are denoted by 1 and 2, respectively; the approximately parallely oriented lines of these two continuous casters 1 and 2 bear the reference numerals A and B. A line is meant to denote the longitudinal central axis of the strand guide along which the strand is conveyed out of the continuous caster. The strands cast in these continuous casters 1 and 2, thus, are each moved along the two lines A and B, respectively, associated with the same. In the strand guide of each of the continuous casters 1 and 2, a separating means is each provided for cutting the strand into lengths, i.e., forming individual strand pieces. The strand pieces are moved on along lines A and B, wherein heat retention furnaces 3 and/or heating furnaces are provided in these lines such that the sensible heat still present in the strand pieces will be available as completely as possible to a subsequent rolling procedure following as immediately as possible.

Aligned with line A of the continuous caster 1 is a rolling mill 4 whose line D coincides with line A. This rolling mill 4 serves to roll out the strand pieces obtained from the two continuous casters 1 and 2.

In order to be able to get a strand piece from the continuous caster 2 and its line B into line D of the rolling mill 4, pivotable guide sections 5 and 6 are provided in each of lines B and D of the continuous caster 2 and the rolling mill 4, respectively, which guide sections advantageously likewise are designed as heat retention furnaces or as heating furnaces. These guide sections 5 and 6 are each pivotable into two positions I and II, i.e., into a first position I depicted in fill lines in FIG. 1 and in which the two guide sections 5 and 6 with their longitudinal axes register with lines B and D, respectively. In a second position II, these guide sections 5 and 6 register with each other, each being in a position oriented at an acute angle relative to lines D and B. These positions II are illustrated by broken lines in FIG. 1. Actuating means of any kind not illustrated in detail serve to pivot the guide sections 5 and 6.

Between the two lines A and D a furnace 7 is provided, which is designed as a temperature equalizing furnace, a heat retention furnace or a heating furnace and advantageously is stationarily arranged. This furnace 7, which serves as a storage furnace, by its longitudinal direction is oriented such that in the positions II of the guide sections 5 and 6 in which the guide sections 5 and 6 associated with lines D and B are in alignment with each other it will register with these guide sections 5 and 6. One guide section 5 and 6 each, with its free end 8, joins an end 9 or 10, respectively, of the furnace 7 in the pivoted position in which the two guide sections 5 and 6 are in alignment with each other. The lengths of the guide sections 5 and 6 and of the furnace 7 arranged between lines D and B is determined as a function of the required specific weights of the strand pieces and the thicknesses of the strand pieces.

The overall plant depicted in FIGS. 1 to 3 functions in the following manner:

If a strand piece such as, for instance, a thin slab is to be transferred from line B into line D of the rolling mill 4, the stand piece at first is introduced into the guide section 6 associated with line B, said guide section 6 being in the position I registering with line B (FIG. 1). After this, the guide section 6 is aligned, i.e., pivoted to register with the furnace 7 located between lines A and D, and the strand piece can be introduced into the furnace 7. This position II is illustrated in FIG. 2.

Figure 3:
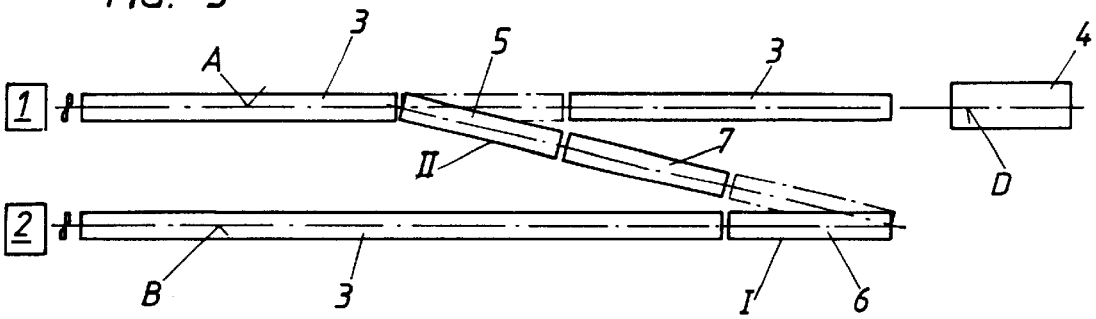

Subsequently, the guide section 6 associated with line B may be pivoted back again so as to be in alignment with line B anew (FIG. 3). As soon as lines D and A have been cleared, i.e. the guide section 5 associated with lines D and A is not occupied, the guide section 5 is pivoted into a position II in alignment with the furnace 7, which position is illustrated in FIG. 3. Now the strand piece can be introduced into the guide section 5 associated with lines D and A, whereupon the guide section 5 may be pivoted back into the position I in alignment with line D and the strand piece can be supplied to the rolling mill 4.

Figure 2:
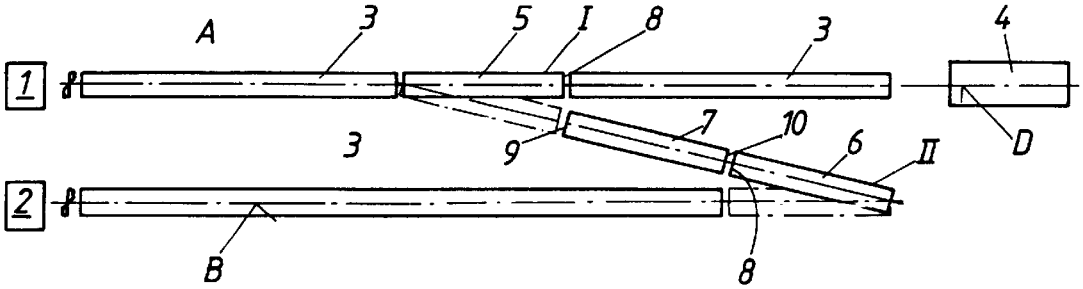

According to FIGS. 1 to 3, the transfer of a stand piece from line B into line D is effected by a two-time inversion of the direction to a major extent. This need, however, not be the case; the arrangement also could be devised such that no inversion of the direction is necessary for diverting the strand piece, but the strand piece during its diversion always merely moves by an acute angle relative to the direction in which it emerges from the casting machine.

In the overall plant position represented in FIG. 1, a strand piece from line A may be fed to the guide section 5 associated therewith and transported further to rolling. At the same time, a strand piece in line B may be introduced into the guide section 6 associated with this line. According to FIG. 2, a strand piece from line B may be introduced into the furnace 7 arranged between lines D and B and, at the same time, a strand piece from line A may be introduced into the guide section 5 associated with this line and further conveyed to rolling. According to FIG. 3, it is feasible to introduce a strand piece from the furnace 7 arranged between lines D and B into the guide section 5 associated with line D, while simultaneously introducing a strand piece in line B into the guide section 6 associated with line B.

Rollers and, preferably driven rollers, are provided in lines A and B for conveying the strand pieces along these lines. The guide sections 5 and 6 also comprise driven rollers, the actuating means having to be reversible in case of an inversion of the direction at a transfer from line B into line D.

The guide section 5, 6 might also be replaced with guide sections capable of being laterally transferred, e.g., by the parallel movement or parallel displacement of the guide sections. In that case, the furnace arranged between lines B and D would be aligned approximately parallel with lines A, B and D.

Figure 4:
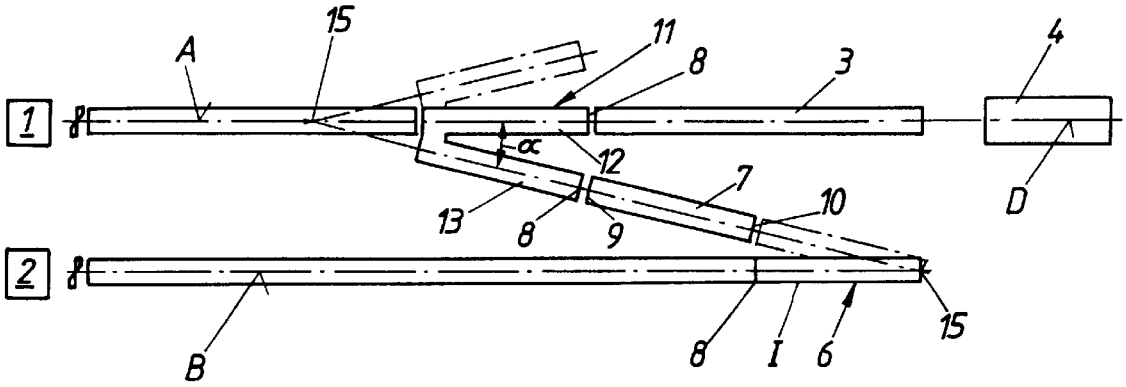
FIGS. 4 to 6 depict another embodiment in illustrations analogous to FIGS. 1 to 3.
Figure 5:
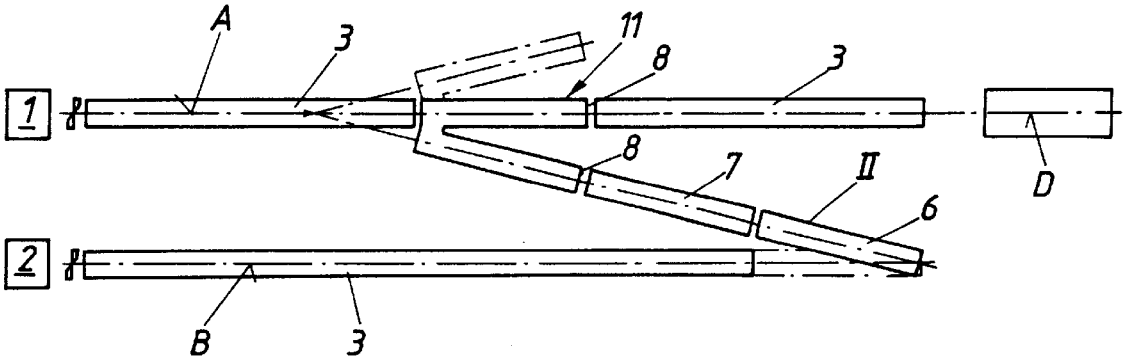
Figure 6:
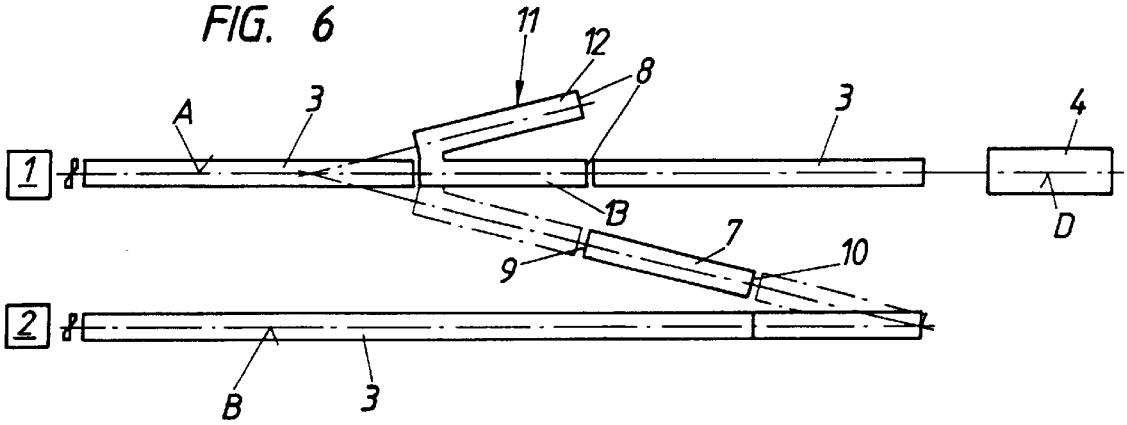

According to the embodiment depicted in FIGS. 4 to 6, a rolling mill 4 is again associated with two continuous casters 1 and 2 in a manner analogous to FIG. 1, yet, as opposed to the embodiment according to FIGS. 1 to 3, a guide section 11 which is comprised of two guide parts 12 and 13 is provided in line D of the rolling mill 4, each of said guide parts serving to receive strand pieces. There could also be provided more than two guide parts. These guide parts 12 and 13 enclose an angle $\alpha$ with each other, the extent of this angle $\alpha$ being chosen such that, according to the position illustrated in fill lines in FIG. 4, one guide part 12 gets into alignment with line A and line D and the other guide part 13 gets into alignment with the furnace 7 arranged between lines D and B. The guide section 6 provided in line B is designed to be equal to the guide section 6 associated with the guide section of line B according to FIGS. 1 to 3.

According to this embodiment, the transfer from line B into line D may be effected within an even shorter time interval than according to the embodiment depicted in FIGS. 1 to 3, since the introduction of strand pieces from the furnace 7 arranged between lines D and B into the guide section 11 of line A, i.e., into the guide part 13 aligned to register with this furnace 7 according to FIGS. 4 and 5, is feasible while conveying strand pieces from line A to the rolling mill 4. After having pivoted the guide section 11 into the position illustrated in FIG. 6, strand pieces from the guide part 13 can be supplied to the rolling mill 4.

Figure 7:
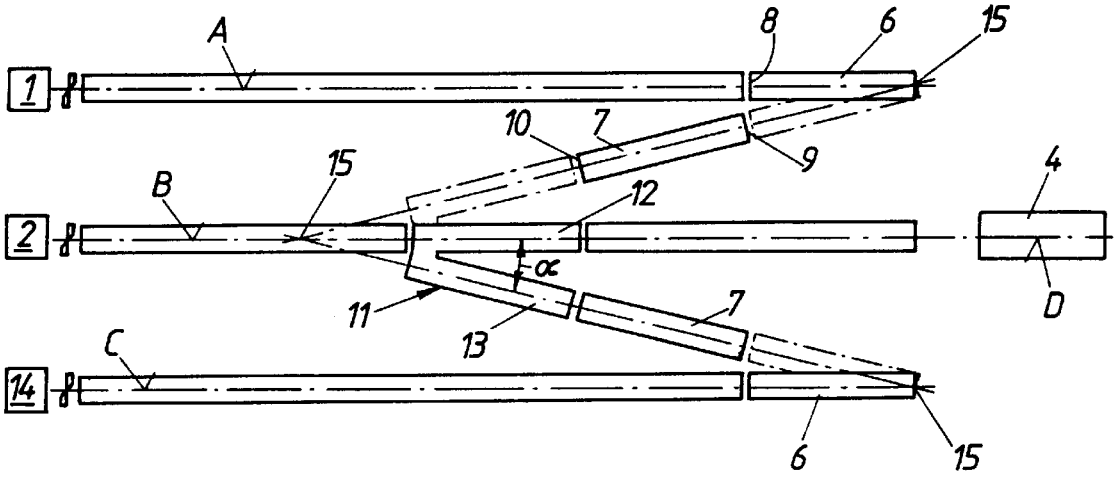
FIGS. 7 and 8 depict a third embodiment in illustrations analogous to FIGS. 1 and 2.
Figure 8:
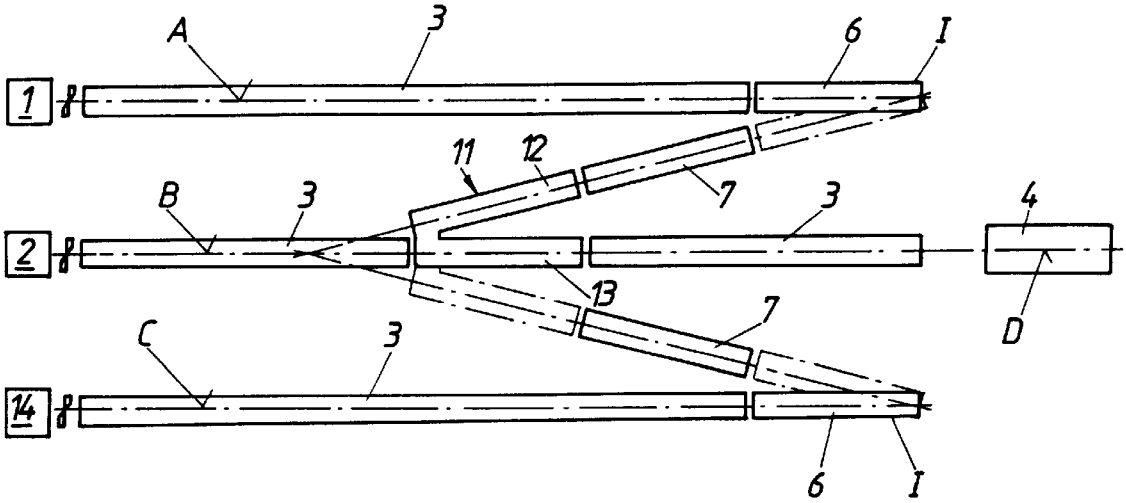

According to the embodiment illustrated in FIGS. 7 and 8, three continuous casters 1, 2 and 14 are adjacently arranged with parallel lines of these continuous casters 1, 2 and 14, namely A, B and C resulting. The rolling mill 4 with its line D is arranged to register with line B. In this case, the guide section 11 comprising two guide parts 12 and 13, which likewise enclose an angle $\alpha$, is arranged in the centrally arranged lines B and D and, by pivoting this guide section 11, it is feasible to align its guide parts 12 and 13 to once register with the furnace 7 arranged between lines A and D and to once register, by the other guide part 13, with the furnace 7 arranged between lines C and D. In both of the pivoted positions represented in FIGS. 7 and 8, one of the guide parts 12 and 13 of the pivotable guide section 11 is each aligned to register with line B and line D, respectively.

The guide section 11 including two V-shaped guide parts 12 and 13 may be replaced with a guide section that is laterally transferable, e.g., parallely movable or parallelly displaceable and equipped with two or several guide parts arranged approximately parallel, wherein the arrangement likewise would have to be such that in one position of the guide section one of the guide parts is in alignment with line D of the rolling mill 4 and the other one of the guide parts is in alignment with the furnace 7 provided between line D of the rolling mill 4 and line A or C of a continuous caster 1 or 14, respectively, which does not register with the rolling mill 4. That other guide part would have to be placeable in alignment with line D of the rolling mill 4 by parallel displacement or movement. It would also be conceivable to equip one guide section with more than two guide parts, which are displaceable in aligned positions with a line of a continuous caster and with the line D of the rolling mill one after the other.

Pivoting of the guide sections 5, 6 and 11 is each effected about a pivot axis 15 located in the respectively associated lines A, B, C, D, wherein the pivot axis 15 of the guide section 11 comprising two V-shaped guide parts 12 and 13 is located in the point of intersection of the longitudinal central axes of these guide parts 12 and 13.

What is essential to all of the embodiments is the arrangement of a furnace 7 and, preferably, of a stationary furnace 7 between line D of the rolling mill 4 and a continuous caster that is not aligned to register with line D of the rolling mill 4. Thereby, decoupling may be realized to the effect that not both of the lines will be blocked simultaneously during the transfer from the line of this continuous caster into line D of the rolling mill 4. Hence results a high plant availability and the feasibility of preventing possible jams which optionally would lead to an interruption of the continuous casting operation.

If the guide sections 5, 6 and 11 are designed as furnaces, the furnaces for economic reasons are configured to each accommodate but a single strand piece, this applying to the guide section 11 to the effect that each of its guide parts 12 and 13 will receive but a single strand piece. The guide sections 5, 6 and 11 do not have storage function but only transporting as well as heat retaining and temperature equalizing functions.

It goes without saying that the number of continuous casters may vary, as may the number of rolling mills associated therewith. Thus, it is, for instance, conceivable to associate two rolling mills with three, four or five continuous casters with the inventive idea being realizable as well.

What we claim is:

1. A process for producing a hot-rolled product, comprising:

continuously casing a strand;

separating a strand piece from the strand;

thermally influencing the strand piece by temperature equalization and/or strand piece heating; and hot-rolling the strand piece;

wherein the continuous casting takes place in at least two continuous casters, and the strand piece is rolled in a rolling mill associated with the continuous casters and to which the strand piece is conducted by diverting the strand piece into a line of the rolling mill from at least one of the continuous casters having a line that does not register with the line of the rolling mill, and wherein thermal influence is effected during the diversion of the strand piece, and wherein thermal influence is effected in a furnace provided between the lines of the continuous casters and the line of the rolling mill and wherein from a line of the continuous casters a strand piece is disposed, while being brought in alignment with the furnace, by means of a pivotable or laterally displaceable guide section of said line of the continuous casters and from the furnace is displaced, while being brought in alignment with the line of the rolling mill, by means of a pivotable or laterally displaceable guide section of the line of the rolling mill, said guide section of the line of the rolling mill being provided at an opposed end of the furnace.

2. The process as set forth in claim 1, further comprising providing a storage furnace and diverting the strand piece from at least one of said continuous casters having its caster line not registering with said rolling mill line by a first inversion of direction and a second inversion of direction, thereby causing said strand piece to pass through said storage furnace in a direction opposite to the direction of casting and rolling after said first inversion of direction and before said second inversion of direction.

3. In a plant for producing a hot-rolled product by continuously casting a strand in at least two continuous casters, separating a strand piece from said strand, thermally influencing said strand piece by temperature equalization and/or strand piece heating, and hot-rolling said strand piece in a rolling mill to which said strand piece is conducted by diversion from at least one of said continuous casters not in line with said rolling mill, of the type including at least two continuous casters each having a longitudinal central axis constituting a caster line, the rolling mill associated with said at least two continuous casters and having a longitudinal central axis constituting a rolling mill line, and pivotable or laterally displaceable guide section means respectively provided in at least one of each of said caster lines and said rolling mill line for said strand piece separated from said strand, the improvement comprising:

a furnace provided between said caster line of one of said continuous casters and said rolling mill line and adapted to receive the strand piece, said furnace having a first furnace end and an opposed furnace end, the pivotable or laterally displaceable guide section means comprising only one guide part and provided in said caster line of one of said continuous casters and adapted to aligningly join said first furnace end, and another pivotable or laterally displaceable guide section means comprising only one guide part and provided in said rolling mill line and adapted to aligningly join said opposed furnace end.

* * * * *